United States Patent [19]

Pugh

[11] Patent Number: 4,841,892

[45] Date of Patent: Jun. 27, 1989

[54] ARTICLE COVER AND SHELTER

[75] Inventor: Billy G. Pugh, Corpus Christi, Tex.

[73] Assignee: Billy Pugh Co., Inc., Corpus Christi, Tex.

[21] Appl. No.: 186,934

[22] Filed: Apr. 27, 1988

[51] Int. Cl.[4] ..... B63C 9/22

[52] U.S. Cl. ..... 114/190; 114/361; 150/154

[58] Field of Search ..... 114/190; 441/80, 81; 224/42.21, 42.24, 42.26, 42.2, 42.25, 273; 150/54 B, 52 R, 55; 296/37.2, 37.3, 97.22

[56] References Cited

U.S. PATENT DOCUMENTS

| | | | |
|---|---|---|---|
| 1,509,859 | 8/1924 | Calkins . | |
| 1,881,634 | 10/1932 | Johnson | 114/190 |
| 1,991,207 | 2/1935 | Hartel . | |
| 2,690,152 | 9/1954 | Riccio . | |
| 3,754,291 | 8/1973 | Harris et al. | 114/190 |
| 3,945,067 | 3/1976 | Salvarezza | 114/190 |
| 4,228,556 | 10/1980 | Searls | 114/190 |

FOREIGN PATENT DOCUMENTS

| | | |
|---|---|---|
| 3014238 | 10/1981 | Fed. Rep. of Germany . |
| 414569 | 9/1910 | France . |
| 747612 | 6/1933 | France . |

*Primary Examiner*—Joseph F. Peters, Jr.
*Assistant Examiner*—Jesûs D. Sotelo
*Attorney, Agent, or Firm*—Stevens, Davis, Miller & Mosher

[57] ABSTRACT

A shelter for a life ring buoy which includes a support for the life ring and a cover wherein the cover has weight secured thereto. The weight, in combination with easy release fasteners on the support secures the cover to the support. The fasteners include open slot fasteners which receive the body of the cable and two closed fasteners which receive the ends of the cable. When the life ring is needed, the cover is easily lifted from the support exposing the life ring.

9 Claims, 2 Drawing Sheets

ARTICLE COVER AND SHELTER

FIELD OF THE INVENTION

The present invention relates generally to article covers and, more specifically, to a life ring buoy cover and shelter.

BACKGROUND OF THE INVENTION

The marine industry requires a shelter to protect equipment at sea. It has long been known that salt water and gale force winds will deteriorate and shorten the useful life of marine equipment such as life-ring buoys. However, if life-saving equipment is too tightly sealed or protected, emergency access to the equipment may not be possible. The loss of human life may result.

SUMMARY OF THE INVENTION

An object of this invention is to construct a shelter including a support and a cover for an article. The cover is easily removed, but securely attached to the support so that the article is protected from exposure to the marine environment.

The invention relates to a shelter for a life ring buoy which includes a support for the life ring and a cover wherein the cover has a weight secured thereto. The weight, in combination with easy release fasteners on the support, secures the cover to the support. The fasteners include open slot fasteners which receive the body of the weight and two closed fasteners which receive the ends of the weight. When the life ring is needed, the cover is easily lifted from the support exposing the life ring.

DETAILED DESCRIPTION OF THE PREFERRED EMBODIMENT

Figure 3:
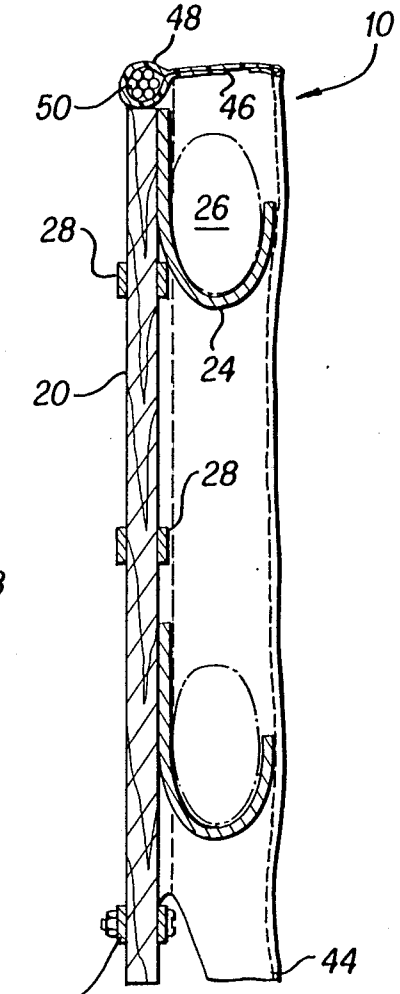
FIG. 3 is a side view, in cross section, of the shelter composed of the article's cover and the article's support, the cross section being taken from the apex of the shelter to its base.
Figure 2:
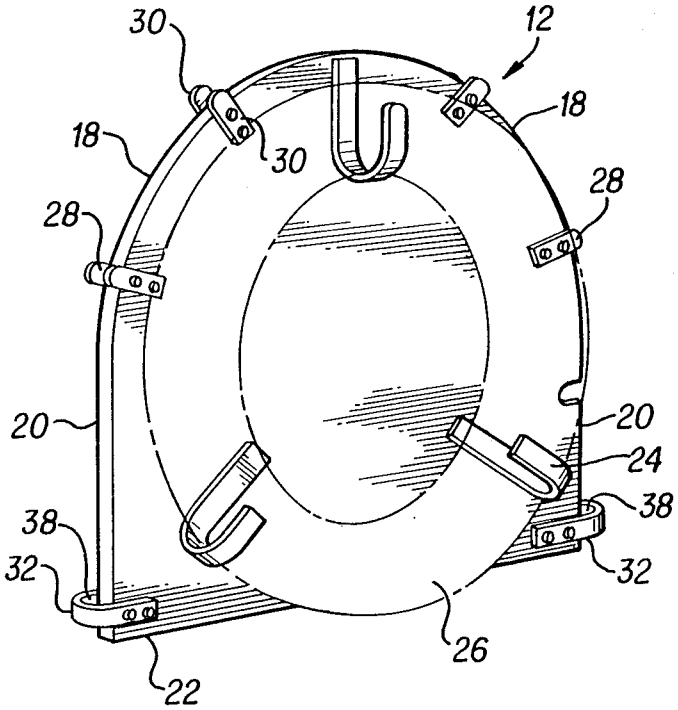
FIG. 2 is a front perspective view of the support for an article.

The shelter 10 of FIG. 3 is preferably designed for protecting life rings from the marine environment. The shelter includes a support 12 shown in FIG. 2 and cover 14 shown in FIG. 1. As seen in FIG. 2 support 12 is composed of a board, preferably of fiberglass construction having a width of about 0.625 inches. Support 12 has a front face 16, a rear face (not shown), a generally arcuate shaped top edge 18, generally linear side edges 20, and a substantially linear bottom edge 22.

Attached to the front face 16 of support 12 are hooks 24 which are arranged in a triangular pattern, as shown in FIG. 2, for detachably supporting a life ring 26 shown in broken lines in FIG. 2.

A plurality of open slotted fasteners 28, manufactured from brass or stainless steel, are secured to the arcuate shaped top edge 18 of support 12. Each fastener 28 is composed of two small ridged strips 30 which have a length about six times longer than their width. These dimensions, however, are not critical. Each strip of a single slotted fastener 28 is secured to opposite faces of support 12 by fastening the bottom portions of strips 30 to support 12 and to one another with fasteners such as nuts and bolts. A top portion of each strip extends beyond the edge of support 12 so that the inside faces of the top portions of strips 30, extending beyond the edge of support 12, oppose one another. This construction forms open slotted fasteners 28.

Figure 5:
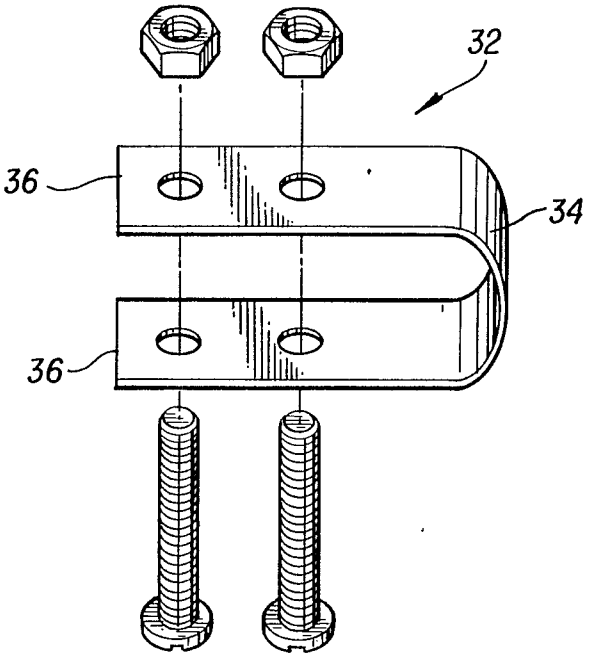
FIG. 5 is a magnified illustration of closed clip fasteners for securing the ends of the cable of the cover to the shelter.
Figure 4:
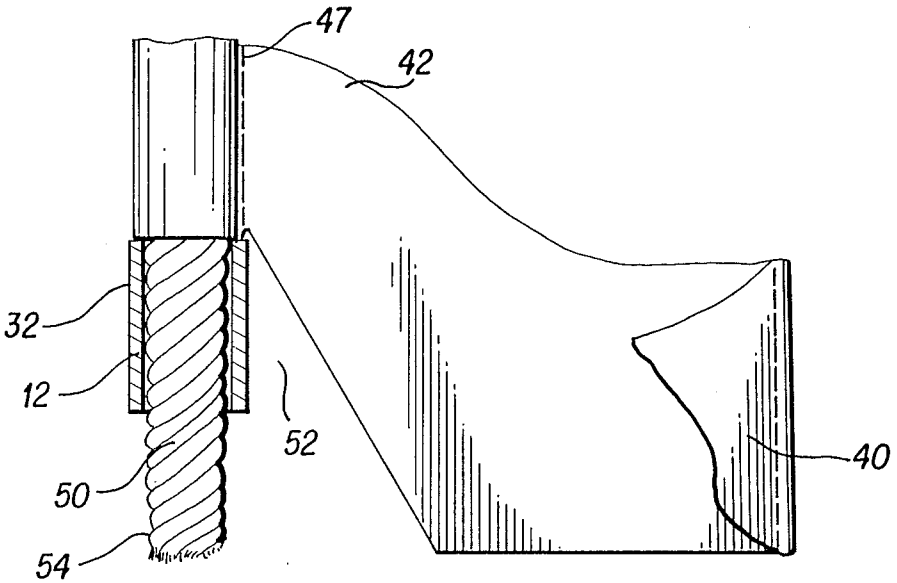
FIG. 4 is a magnification of the cut out 52 of the cover showing end 54 of weight 50 seated in closed fastener 32 shown in section.

Secured to linear side edges 20 on the left and right sides of support 12 near bottom linear edge 22 are two closed fasteners 32. A single closed fastener 32 is shown in FIG. 5. Closed fasteners 32 are U-shaped and the arcuate portion 34 of each of the closed U-shaped fasteners 32 extends beyond the linear side edges 20 of support 12, with the side portions 36 of the closed fasteners being secured to opposite faces of support 12 and to one another by fasteners such as nuts and bolts as shown in FIG. 5. In this manner, a slot 38 (FIG. 2) is created between the arcuate end of the fasteners 32 and the linear side edge 20 of support 12.

Cover 14 (FIG. 1) is composed of a flat sheet 40 and a linear strip of material 42 which forms the side edges of cover 14. Sheet 40 is substantially similar in shape to support 12, but sheet 40 has a surface area slightly larger than that of the front face 16 of support 12. Cover 14 is preferably made of orange colored vinyl plastic.

Figure 1:
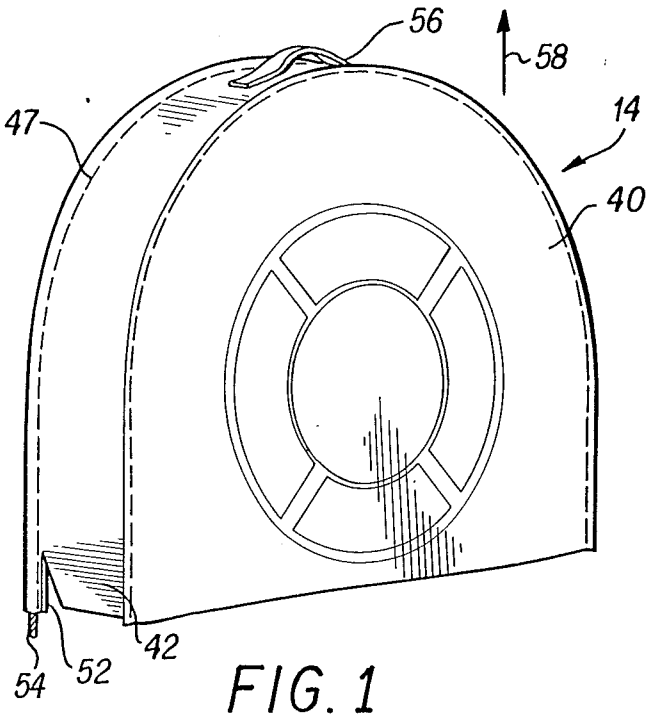
FIG. 1 is a front perspective view of a preferred embodiment of the cover for an article.

Linear strip 42 has first and second long edges and is substantially equal in length to the sum of all the edges of the sheet 40, excluding the bottom edge of sheet 40. A first long edge 44 of linear strip 42 is sewed to every edge of sheet 40, except the bottom edge of sheet 40 (see FIG. 3). Linear strip 42 gives volume and width to cover 14. A second long edge 46 of linear strip 42 is folded back on the remaining portion of itself, as shown at the top of FIG. 3, and is fastened thereto, for example by stitching 47 (FIG. 1) creating a pocket 48 as seen in FIG. 3. The length of pocket 48 is substantially equal to the length of linear strip 42. Pocket 48 receives a round elongated flexible weight 50 such as a flexible strip of rubber, a metal cable or the like which is approximately 4 to 8 inches longer than the length of linear strip 42. Preferably a metal cable is used. As shown in FIGS. 1 and 3 a triangular cut out 52 is formed on both sides of the bottom ends of linear strip 42 so that a first leg of the triangle formed borders stitching 47.

Cover 14 with its weighted pocket is placed over support 12 supporting life ring 26, so that the weighted pocket 48 of cover 14 is secured to open slotted fasteners 28 by being seated in the open slots created between the strips 30 making up fasteners 28. The ends 54 of weight 50 which extend beyond the pocket on either side thereof by about four inches are then seated within slots 38 of closed fasteners 32 so that together the cover 14 and support 12 form a shelter for life ring 26.

The shelter thus created keeps life ring 26 from being exposed to the marine environment. However, when the life ring is needed in an emergency, the cover can be easily removed by pulling upward on a handle 56 which may be fastened at a midportion of linear strip 42, which is the apex of cover 14.

By pulling on handle 56 in the direction of arrow 58, the ends 54 of weight 50 are unseated from slots 38 and simultaneously the remainder of weight 50 within the pocket 48 is unseated from open slotted fasteners 38 so that the life ring is completely and quickly exposed for use in an emergency situation.

While the device of the instant invention has been described and illustrated, it should be apparent that many modifications may be made thereto without departing from the spirit and scope of the invention. Accordingly, the disclosed invention is not limited by the foregoing description, but is only limited by the scope of the claims amended thereto.

I claim:

1. A cover for a life ring, said life ring being detachably connected to a vertically disposed life ring support;

said cover having dimensions to shelter a face of said life ring, and said cover comprises a flat flexible sheet having a bottom edge and a flexible strip of material having first and second long edges, said first edge being secured to all edges of said sheet excluding the bottom edge thereof giving volume to said cover; and a flexible elongated weight secured by the second long edge of said strip of material and being at least equal to the length of said strip of material.

2. The cover of claim 1 wherein said second long edge of said strip of material is folded back onto and secured to a remaining portion of said strip of material creating a pocket for receiving said flexible elongated weight, said weight being longer in length than the length of the strip of material.

3. A shelter for an article, comprising:

(a) a support for said article;

(b) a flexible cover for said article and said support, said cover having a bottom edge and at least one face, and a strip of material having first and second long edges, said strip of material being substantially equal in length to the sum of all the edges of the face of said cover excluding the bottom edge thereof, said first long edge of said strip of material being fastened to all edges excluding the bottom edge of said face;

(c) a flexible elongated weight and means for fastening said flexible elongated weight to the second long edge of said strip of material; and (d) means for securing the cover to said support for quick detachable release.

4. The shelter of claim 3 wherein said flexible elongated weight is at least equal in length to the length of the strip of material.

5. The shelter of claim 4 wherein said flexible elongated weight is a metal cable having two ends.

6. The shelter according to claim 5 wherein said support, and said cover have an arcuate shaped top portion, and wherein a handle is attached to an apex of the top portion of said cover.

7. The shelter according to claim 6 wherein said means for securing the cover to said support comprises at least two open slotted fasteners said open slotted fasteners being comprised of two elongated strips, said strips being fastened to opposing faces of said board so that a top portion of the strips extend beyond the edge of said board and inner faces of said strips oppose one another.

8. The shelter according to claim 7 wherein said means for securing further comprises two U-shaped fasteners secured on opposite bottom side edges of said support so that the arcuate ends of said U-shaped fasteners extend beyond said side edges forming slots defined by said arcuate ends and said side edges, wherein the ends of said weight are seated in said slots.

9. The shelter according to claim 3 wherein said support comprises a vertically disposed board having means for detachably supporting a life ring.

* * * * *